US006385295B1

(12) United States Patent
Van De Vorst et al.

(10) Patent No.: US 6,385,295 B1
(45) Date of Patent: May 7, 2002

(54) X-RAY TUBE PROVIDED WITH A RARE EARTH ANODE

(75) Inventors: Michel Theodorus Henricus Van De Vorst; Jacobus Louis Dresens, both of Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/713,875

(22) Filed: Nov. 16, 2000

(30) Foreign Application Priority Data

Nov. 19, 1999 (EP) ..... 99203872

(51) Int. Cl.[7] ..... H01J 35/08
(52) U.S. Cl. ..... 378/143; 378/144
(58) Field of Search ..... 378/143, 144

(56) References Cited

U.S. PATENT DOCUMENTS 3,992,633 A * 11/1976 Braun et al. ..... 250/503
5,159,619 A * 10/1992 Benz et al. ..... 378/143
5,875,228 A * 2/1999 Truszkowska ..... 378/144

FOREIGN PATENT DOCUMENTS

EP 0305547a1 3/1989 ..... H01J/35/10

* cited by examiner

*Primary Examiner*—Robert H. Kim
*Assistant Examiner*—Jurie Yun

(57) ABSTRACT

X-rays of a specific wavelength are required for some analytical applications. Such soft X-rays can be obtained by irradiating a secondary target with X-rays of a suitable wavelength. According to the invention there is formed an X-ray tube 1 with an anode surface layer 7 containing a rare earth metal, preferably Gd or Dy. When a secondary target containing La is irradiated with K radiation from such a tube, La K radiation is generated which can be used for analysis of elements of the fifth row of the periodic table. In a preferred embodiment the rare earth metal is bonded to the anode body 4 by way of an intermediate layer 8 of Ti or Mo.

4 Claims, 1 Drawing Sheet

X-RAY TUBE PROVIDED WITH A RARE EARTH ANODE

FILED OF THE INVENTION

The invention relates to an X-ray tube which includes an anode assembly provided with a surface layer for producing X-rays.

An X-ray tube of this kind is known from European patent application EP 0 305 547 A1. The X-ray tube described in the cited patent document is provided with an anode assembly which includes an anode body of graphite on which there is provided a surface layer of tungsten or a tungsten rhenium alloy. This surface layer serves to produce X-rays of a wavelength which is suitable for medical applications, notably for so-called Computed Tomography (CT) applications.

For analytical purposes, for example fluorescent X-ray analysis, it is often desirable to have an X-ray source available which produces spectrally pure X-rays enabling the analysis of geologically important elements. These elements often lie in the fifth row of the periodic system, such as Ag, Cd, In, Sn, Sb, Te and I. It is then desired to excite the K lines of these elements. The customary analytical X-ray tubes available do not produce characteristic lines in the desired energy range which can be used for the excitation of said elements. When use is made of Rh (the most commonly used anode material), for example they are all situated to the high-energetic side of the Rh K lines.

SUMMARY OF THE INVENTION

It is an object of the invention to provide an X-ray tube which can be used for the analysis of said elements. To this end, the X-ray tube according to the invention is characterized in that the surface layer contains at least one rare earth metal. Such a tube can operate with an acceleration voltage of the order of magnitude of, for example 80 kV, thus generating the K line of the material of the surface layer. This K line can irradiate a secondary X-ray target containing La, for example $LaB_6$; K lines of La are generated by fluorescence during this process. The latter K lines can excite the K lines of said elements of the fifth row to be analyzed. If an even higher spectral purity is desired, the geometry of the analysis arrangement can be chosen in such a manner that the angle between the radiation incident on the secondary target and the radiation generated therein by fluorescence is substantially 90°. The part of the radiation incident on the secondary target and scattered by the target, already being small, is then polarized instead of being converted by fluorescence, so that this polarized radiation is no longer seen when observed in the direction perpendicular to the direction of incidence as well as to the direction of departure. The spectral purity of the La K radiation is thus further enhanced. La L lines are also formed under the influence of the L lines of the material of the surface layer; these La L lines can also be used to excite lighter elements, for example chromium (Cr), or an element having a lower atomic number.

In one embodiment of the invention the rare earth metal is one of the elements of the group bearing the atomic numbers 62 up to and including 71. These elements have a wavelength of the K line which is particularly suitable for a secondary target containing lanthanum.

The rare earth metal in a further embodiment of the invention is gadolinium or dysprosium. The advantage of this step resides in the fact that the L lines of these materials have a wavelength such that upon Bragg reflection on a LiF crystal (i.e. the 220 reflection) the angle between the incident radiation and the reflected radiation is substantially 90°. LiF crystals are monochromator crystals commonly used for X-ray analysis. Due to the described Bragg reflection process the radiation of the L line reaching the sample to be analyzed is polarized, so that a contribution due to GdL radiation scattered on the sample, if any, will not be observed upon said observation at right angles.

The anode assembly in a preferred embodiment of the invention is constructed as an anode body whereto the surface layer is bonded by way of an intermediate layer which is provided between the surface layer and the anode body and contains titanium (Ti) and/or molybdenum (Mo).

This step offers the following advantage. An anode assembly of an X-ray tube generally consists of an anode body with a high thermal conductivity, for example copper or silver. To the anode body there is connected the surface layer of the material suitable for the desired radiation, so a rare earth metal in the present case. The heat developed in the surface layer is dissipated by a cooling liquid, for example water, via the anode body. It is specified that the anode of an X-ray tube should have a high thermal strength and that the surface layer should remain firmly attached to the anode body throughout the service life of the X-ray tube, so also at high temperatures and with changing loads across the entire surface. However, it may occur that rare earth metals cannot be readily bonded to noble metals (Ag, Au) or copper (Cu) or to transition metals such as iron (Fe), cobalt (Co) or nickel (Ni). Such difficult bonding is caused by a known phenomenon called "ultra fast diffusion". A rare earth metal forms an intermetallic compound with said materials of the anode body at low temperatures already; these compounds are liquid at a low temperature. For example, Gd—Ni already liquefies at 645° C. Furthermore, such bonds are brittle and hard and often cannot withstand thermal stress very well, so that cracks are liable to occur in these layers and hence the anode becomes useless for analytical purposes. Further details concerning this phenomenon are described in an article entitled "Diffusion in Rare Earth Metals" in "Handbook on the Physics and Chemistry of Rare Earths", North Holland Publishing Company, 1978. It has been found that the rare earth metal does not form a combination with the material of the underlying anode body when an intermediate layer of Ti and/or Mo is provided. Even though said intermediate layers form a combination with the rare earth metal, they exhibit only little or no diffusion. Furthermore, they can be bonded to the anode body in a stable manner, for example by way of diffusion bonding.

The anode body in an advantageous embodiment of the invention contains copper (Cu) and/or silver (Ag). Said favorable properties of the intermediate layer, such as non-brittleness and the absence of "ultra fast diffusion", become manifest particularly well in combination with these materials for the anode body.

BRIEF DESCRIPTION OF THE DRAWING

The invention will be described in detail hereinafter with reference to some Figures. Therein.

DETAILED DESCRIPTION OF THE PREFERRED EMBODIMENTS

Figure 1:
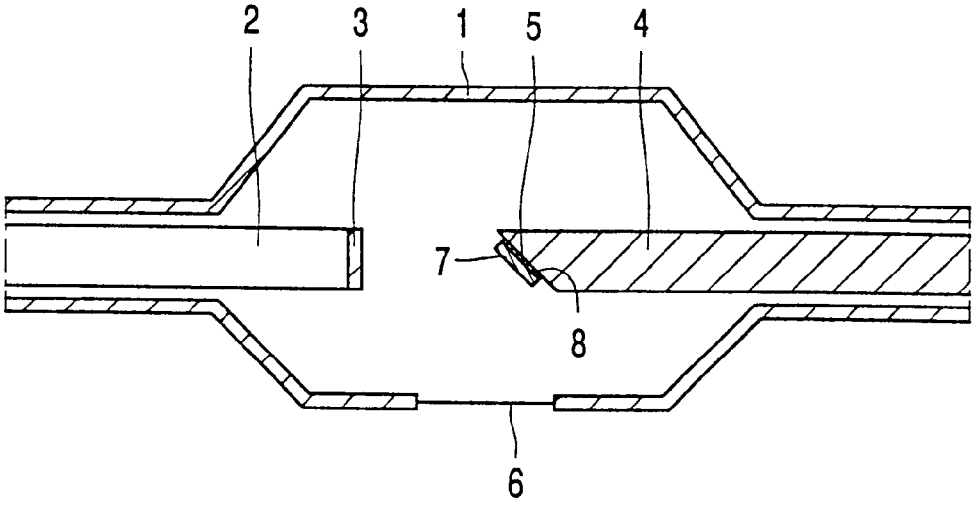
FIG. 1 shows an X-ray tube according to the invention.
Figure 2:
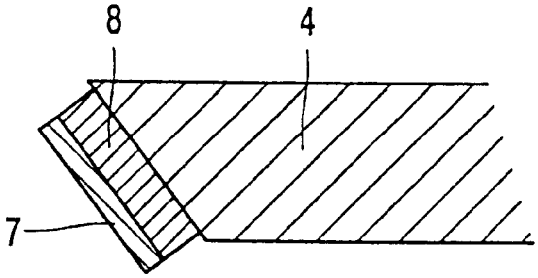
FIG. 2 shows the anode assembly according to the invention in greater detail.

The FIGS. 1 and 2 show a reflection X-ray tube with a housing 1 in which a cathode 2 with an electron-emissive element 3 is arranged in vacuum. The tube also includes an anode assembly which consists of an anode body 4, a surface layer 7 and an intermediate layer 8. A high voltage of, for example 80 kV is present between the anode and the cathode during operation. The electrons emanating from the emissive element 3 are accelerated by said high voltage and are incident on the anode so that X-rays are generated in the surface layer 7. A sample to be examined in an X-ray analysis apparatus can be irradiated by means of the X-rays emanating through an exit window 6. The anode body 4 preferably consists of a thermally suitably conductive material such as copper (Cu) or silver (Ag). The heat developed upon incidence of the electrons is transferred in known manner from the anode body to a cooling medium (for example, water) which is not shown in the Figure. The surface layer 7 consists of a rare earth metal, preferably gadolinium (Gd) or dysprosium (Dy). Between the surface layer 7 and the anode body 4 there is provided an intermediate layer 8 which consists of titanium or molybdenum. Due to the deposition of this intermediate layer of Ti and/or Mo, the rare earth metal will not combine with the copper or silver of the underlying anode body 4. Said intermediate layer materials can combine with the rare earth metal, but exhibit no or hardly any diffusion.

Said materials can be bonded to the anode body in a stable manner by way of diffusion bonding. During the diffusion bonding process there is formed a stack which consists of the silver or copper anode body 4, a sheet of titanium for the intermediate layer 8, and a sheet of gadolinium or dysprosium for the surface layer 7. This stack is compressed at a pressure of approximately $3.5\times10^5$ N $m^2$ in a protective gas atmosphere of argon while being heated to approximately 750° C. This results in a bond between said metal layers which is sufficiently stable for use in an anode assembly for an analytical X-ray tube. When molybdenum is used as the material for the intermediate layer, the molybdenum is first provided with a layer of gold on the side intended to be connected to the anode body. The intermediate layer thus formed is subsequently assembled with the anode body and the surface layer in the same way as in the case of the titanium intermediate layer.

What is claimed is:

1. An X-ray tube comprising an anode assembly provided with a surface layer for producing X-rays, wherein the surface layer contains at least one rare earth metal, and wherein the rare earth metal is one of the elements of the group bearing the atomic numbers 62 up to and including 71.

2. An X-ray tube as claimed in claim 1, wherein the rare earth metal is gadolinium or dysprosium.

3. An X-ray tube as claimed in claim 1, wherein the anode assembly is constructed as an anode body (4) whereto the surface layer (7) is bonded by way of an intermediate layer (8) which is provided between the surface layer (7) and the anode body (4) and contains titanium (Ti) and/or molybdenum (Mo).

4. An X-ray tube as claimed in claim 3, wherein the anode body (4) contains copper (Cu) and/or silver (Ag).

* * * * *